United States Patent [19]

Ikeda et al.

[11] Patent Number: 4,714,401

[45] Date of Patent: Dec. 22, 1987

[54] GOVERNING MODE CHANGE-OVER APPARATUS

[75] Inventors: Hiraku Ikeda; Hidesumi Kuwashima, both of Hitachi, Japan

[73] Assignee: Hitachi, Ltd., Tokyo, Japan

[21] Appl. No.: 792,196

[22] Filed: Oct. 28, 1985

[30] Foreign Application Priority Data

Oct. 31, 1984 [JP] Japan ..... 59-227754

[51] Int. Cl.[4] ..... F01D 17/04

[52] U.S. Cl. ..... 415/30; 415/38

[58] Field of Search ..... 415/1, 17, 29, 38, 30

[56] References Cited

U.S. PATENT DOCUMENTS 3,728,018 3/1973 Uchiyama et al. ..... 415/30

3,891,344 6/1975 Braytenbah ..... 415/1

FOREIGN PATENT DOCUMENTS 41703 3/1977 Japan ..... 415/38

50203 5/1981 Japan ..... 415/36

*Primary Examiner*—Robert E. Garrett

*Assistant Examiner*—John T. Kwon

*Attorney, Agent, or Firm*—Antonelli, Terry & Wands

[57] ABSTRACT

A governing mode change-over apparatus of a steam turbine comprising a switching arrangement between a throttle governing mode and a nozzle governing mode, and an arrangement for controlling a load by selectively subjecting one of the steam control valves to load control during the governing mode switching, whereby the turbine is switched from one of the throttle and the nozzle governing modes to another with a limited fluctuation of the load.

4 Claims, 4 Drawing Figures

GOVERNING MODE CHANGE-OVER APPARATUS

BACKGROUND OF THE INVENTION

The present invention relates to a governing mode switching apparatus for steam turbnes and, more particularly, to a governing mode change-over apparatus designed to minimize the load change on the steam turbine when switching.

Conventionally, the speed of a steam turbine is controlled by two modes: the throttle governing mode in which a plurality of steam control valves (flow rate control valves) are simultaneously opened, and the nozzle governing mode in which a plurality of control valves are opened successively one by one. It is well known that each governing mode has its advantages and disadvantages, depending on the valve opening characteristics of its own. For instance, in the throttle governing mode, steam is uniformly supplied to the whole portion of the steam turbine because the steam control valves are simultaneously opened at the same opening rate, so that the turbine temperature is uniformly raised thus minimizing thermal stress. In this case, however, the loss of steam energy is inevitably caused during throttling, because the steam control valves are only gradually opened, so that the efficiency is lowered in the partial load operation of the steam turbine. On the other hand, in the nozzle governing mode, the steam control valves are individually sequentially opened, so that the loss of steam energy is minimized because each valve can open quickly. In this case, however, a large temperature difference is caused between the portion of the turbine downstream of the valve which has been already opened and the portion downstream of the valve which is still closed.

In the case of a power generating steam turbine having high output, the selection between these two types of governing modes has been determined mainly from the viewpoint of operation characteristics required for these turbines. For instance, with a power generating steam turbine intended for peak load, i.e., a medium size electric power plant which is started early in the morning and stopped late at night so as to meet the daytime peak load, the throttle governing mode is preferably used because it minimizes thermal stress despite the frequent starting and stopping of the turbine. On the other hand, with steam turbines which are intended for base load, i.e., power generating turbines which are operated continuously to bear the base load throughout a year; hence, are stopped, and started once or so a year, the nozzle governing mode is preferably used because it can ensure a high thermal efficiency over a wide load range and because the problem concerning the start-up is not so severe.

Thus, conventional turbine control systems have selectively adopted either one of these modes for coping with the demand.

A turbine control system has been proposed in, for example, Japanese patent Publication No. 7123/1971, wherein the speed is governed in the throttle speed governing mode when the load is lower than a predetermined level, e.g., 50%, whereas, when this predetermined load level is exceeded, the speed is governed in the nozzle governing mode. This turbine control system, however, involves a problem such that, for instance, the nozzle governing mode cannot be used at 30% load, while, at 70% load, the throttle governing mode cannot be used, because the level of the load at which the change-over between two modes is conducted is fixed.

In a steam turbine with a nozzle governing system, severe erosion is caused in a specific nozzle because the steam is supplied only through that nozzle during partial load. This erosion is made worse by thermal stress.

Nozzle erosion is primarily caused by boiler scale which is most severe immediately after plant has been started up after being shut down for a while. Erosion decreases rapidly after this. With this knowledge, it has been proposed to use a throttle governing mode during a start-up after a stop and switch it into a nozzle governing mode after scale and other foreign matter have been disposed off, regardless of the load level, thereby affording high thermal efficiency. For this purpose a mechanical type controller has been proposed to control a turbine. In this proposed arrangement, two cams having different countours corresponding to the throttle governing mode and the nozzle governing mode are used and the switching between these two modes is conducted by utilizing one of the cams as a fulcrum while the other is being used.

In this switching system, since one of the cams is a fulcrum while the other is used, there is a risk that, for example the valve subjected to load control immediately before the governing mode change-over is not operated at a predetermined load but is temporarily closed to an degree of opening less than or greater than the opening necessary for the load.

Another problem is that, since all valves are operated simultaneously actuated, the aggregate fluctuation of all valves causes a large fluctuation in the total flow rate of the steam passing through the steam control valves, resulting in a large change in the output power of the generator.

An object of the invention is to provide a governing mode switching apparatus which is capable of switching between the nozzle governing mode and the throttle governing mode, while controlling the load at a constant level, thus minimizing the change in the load during the switching of the governing mode.

In accordance with advantageous features of the present invention, at least one of the steam control valves is subjected to load control so that the load is controlled at a constant level, while the other steam control valves are operated to the desired degree of opening during the governing mode change-over.

DETAILED DESCRIPTION

Figure 1:
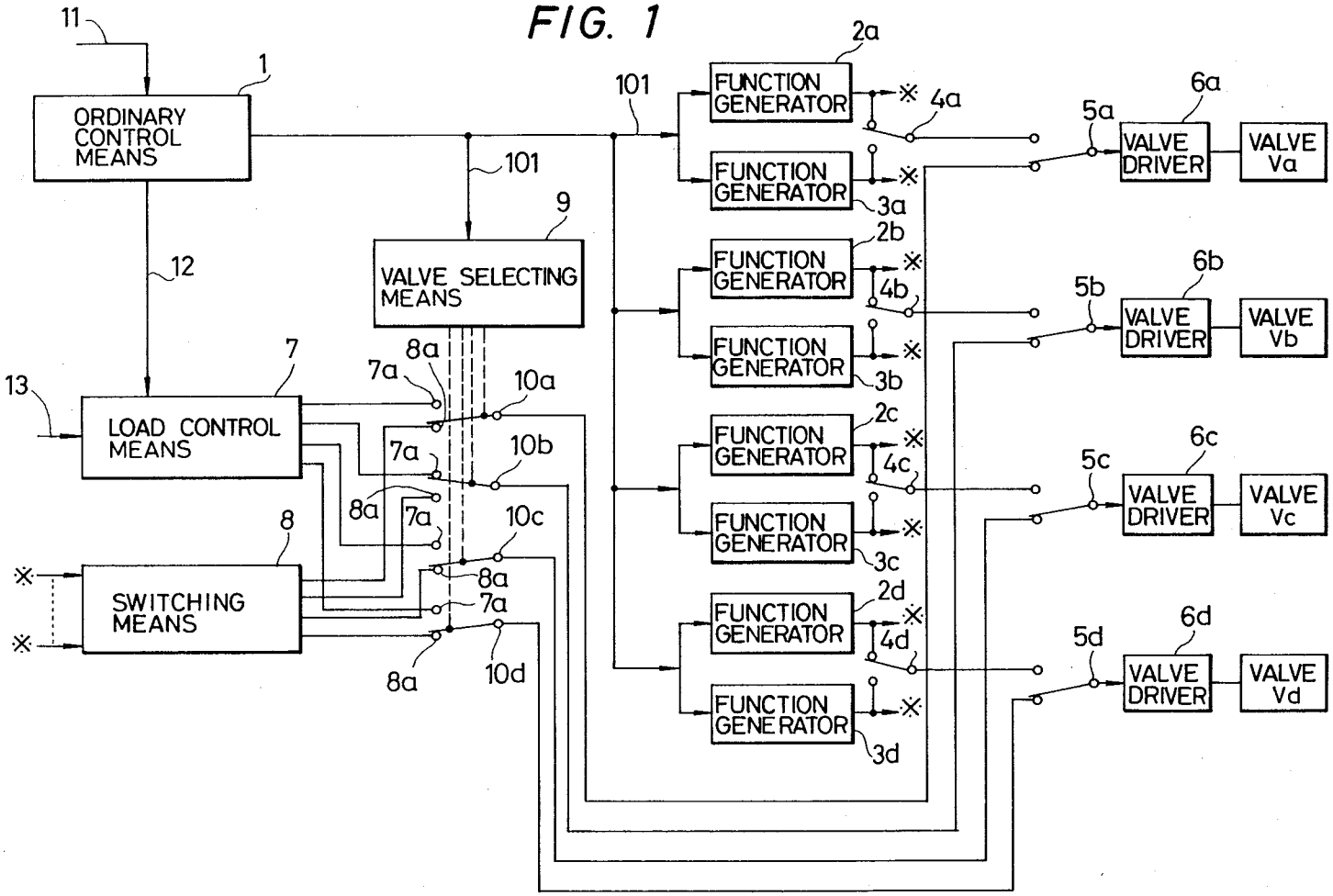
FIG. 1 is a block diagram of an embodiment of the prevent invention.
Figure 2:
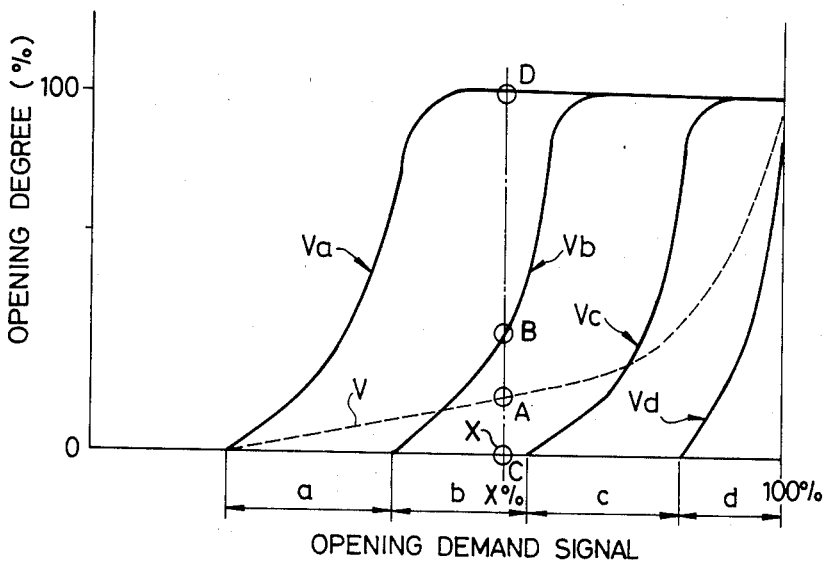
FIG. 2 is a graphical illustration depicting the governing mode change-over apparatus and selection for a valve when switching the governing mode.
Figure 3:
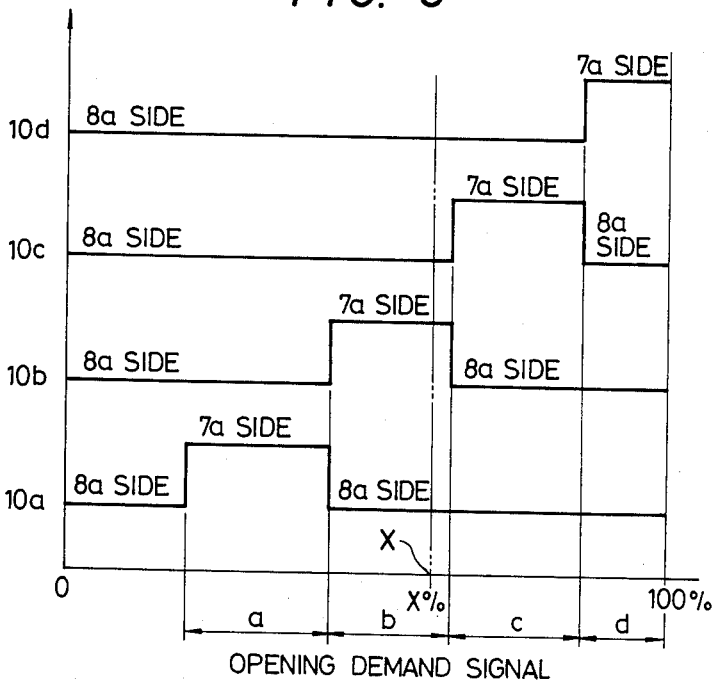
FIG. 3 is a diagram depicting function of valve selecting means.
Figure 4:
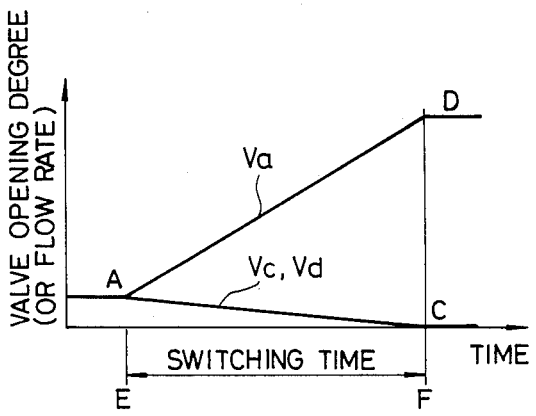
FIG. 4 is a diagram for explaining valve switching by a valve opening switching means.

Referring now to the drawings wherein like reference numerals are used throughout the various views to designate like parts and, more particularly, to FIGS. 1–4, according to these figures, a governing mode change-over apparatus in accordance with the present invention is installed in a turbine which has four steam control-valves Va, Vb, Vc and Vd, with each of the control valves controlling a supply of steam to one fourth of a plurality of annularly arranged nozzles. As shown in FIG. 1, an ordinary turbine control means 1 is provided for controlling the opening of the steam control valves under ordinary or normal operation of the turbine and for generating steam control-valve degree of opening demand signal 101 (hereinafter referred to as opening demand signal) referring to a set load. The turbine is operated at the set load when the control valve or valves are opened at an opening corresponding to the turbine opening demand signal, the control means 1 being conventional. Function generators 2*a* to 2*d*, for throttle goverining, respectively provided for the steam control-valves Va to Vd, are provided for converting the opening demand signals from the turbine control means 1 into steam control-valve opening signals for respective steam control valves in the throttle speed governing mode. FIG. 2 illustrates a valve opening characteristic curve V in the throttle governing mode. In this mode, all the control valves are opened and closed according to the function given by the curve V while all maintaining the same opening. When an opening demand signal x corresponding to load x% as shown on the abscissa of FIG. 2 is given by the control means 1, the function generators 2*a* to 2*d* generate the control-valve opening signal "A" given on the ordinate of FIG. 2 according to the curve V. Function generators 3*a* to 3*d* for nozzle governing are respectively provided for the steam control-valves Va to Vd, to convert the opening demand signals into steam control-valve opening signals for respective steam control valves in the nozzle governing mode. Curves Va to Vd in FIG. 2 each represent valve opening characteristic curves in the nozzle governing mode. The opening of each control valve Va, Vb, Vc, Vd is controlled according to the function given by the valve opening characteristic curve. The valves are individually sequentially opened and closed according to the function. For example, when the opening demand signal x is given, the control-valve opening signals "D", B" and "C" for each of the control valves Va to Vd are given on the ordinate in FIG. 2. Throttle/-nozzle switching means 4*a* to 4*d* are provided for the steam control valves Va to Vd, for switching between the steam control-valve opening signals for the throttle governing mode and ones for the nozzle governing mode, and the switching is effected by an operator. Opening signal switching means 5*a* to 5*d*, one for each of the steam control valves Va to Vd, are provided for switching the steam control-valve opening signals between the state in which the governing modes are being switched and the state in which the turbine is under ordinary operation, which switching is conducted manually. Steam control-valve driving means 6*a* to 6*d*, each of which is provided for each of the steam control-valves Va to Vd, all provide for driving the valves to control the degree of opening according to the steam control-valve opening signals. A load control means 7 compares the actual load 13 of the generator and a signal 12 of the set load from the control means 1 to output the opening signals to the steam control-valves such as to nullify the offset. A steam control valve opening switching means 8 is electrically connected to the function generators 2*a* to 2*d* for throttle governing and the function generators 3*a* to 3*d* for nozzle governing and generates signals for controlling the opening of the steam control valves Va to Vd during switching of the governing modes upon receipt of the output from the function generators 2*a* to 2*d* and the function generators 3*a* to 3*d* immediately before switching. Namely, when the throttle governing mode is changed over to the nozzle governing mode, and the opening demand signal x (which is a signal demanding for the opening corresponding to x% partial load) is issued from the turbine control means 1, the output of the function generators 2*a* to 2*d* is an opening signal of point A and the function generators 3*a* to 3*d* output an opening signal of point D for the valve Va, an opening signal of point B for the valve Vb, and opening signals of point C for the valves Vc and Vd. The opening switching means 8 generate the opening control signals such that, for the valve Va, the opening is changed from the opening A to the opening D, and for the valves Vc and Vd from the opening A to the opening C, respectively, in a predetermined switching time as shown in FIG. 4, based on the outputs from the two type function generators 2*a* to 2*d* and 3*a* to 3*d*. The valve Vb is subjected to the load control during the switching, which is described more fully hereinbelow.

On the other hand, when the nozzle governing mode is switched to the throttle governing mode, the opening of the control valves of opening at points D, C are changed to the opening A and valve Vb of the opening B is subjected to load control which also is described hereunder.

An instruction which to be changed to throttle governing or nozzle governing occurs by changing a voltage or current of the function generators caused by the switching operation of the throttle/nozzle governing switching means 4*a* to 4*d*. For example, when the throttle/nozzle governing switching means is switched from the throttle governing side to the nozzle governing side, the instruction that the throttle governing is switched to the nozzle governing is inputted into the opening switching means 8.

A valve selecting means 9 is for selecting, in accordance with the opening demand signal 101 outputted from the control means 1, the steam control valve, for example valve Vb, through which the generator output is held constant during switching. Namely, referring back to FIG. 2, the selecting means select the valve such that when opening demand signal 101 is in the region (a), the valve Va is selected for load control, the valve Vb in the region (b), the valve Vc in the region (c), and the valve Vd in the region (d). And opening signal switching means having contacts 10*a* to 10*d* driven by signals from the valve selecting means 9 during switching operation to connect electrically the contacts 10*a* to 10*d* with contacts 7*a* or 8*a* are provided. The valve selecting means 9 generates electric signals for connecting the contacts 10*a* to 7*a* side when received the opening demand signal in the region (a) and the contact 10*a* to 8*a* side when received opening demand signals in the regions (b), (c) and (d). In this manner, as for the contacts 10*b* to 10*d* the selecting means 9 generates valve selecting signals as shown in FIG. 3 according to the opening demand signal 101.

The steam control valves Va to Vd are controlled as follows during normal operation, i.e., when the steam turbine is operated either in the nozzle governing mode or the throttle governing mode.

It is assumed here that the steam turbine is being controlled in the throttle governing mode. In this case, the ordinary turbine control means 1 outputs a steam control valve opening demand signal 101 which is a function of the set load and a control object such as turbine speed, extraction steam pressure, steam pressure at the turbine outlet and the steam pressure at the turbine inlet, or corresponding to the limit load. This signal is delivered to the throttle governing function generators 2a to 2d in which the signals 101 are converted into steam control valve opening signals. The steam control valve opening signals are delivered through the throttle/nozzle governing switching means 4a and 4d and through the ordinal/change-over switching means 5a to 5d to the steam control valve driving means 6a to 6d, thereby controlling the degree of opening of the steam control valves.

When the turbine is being controlled in the nozzle governing mode, the operation is substantially the same as that in the throttle speed governing mode, except that the throttle/nozzle switching means 4a to 4d have been switched to the nozzle governing function generators 3a to 3d so that the output signals from the function generators 3a to 3d are inputted to the steam control valve driving means 6a to 6d instead of the signals from the throttle governing function generators 2a to 2d.

A set load signal 12 is inputted in the load control means 7 from the ordinary control means 1 prior to switching the speed governing mode, while the valve selecting means 9 receives a valve selecting signal so that it selects the steam control valve which is to control the load when switching the speed governing mode. At the same time one of the switching means 10a to 10d have been switched for load control means so that the steam control valve opening signal are given by the load control means 7 when switching the speed governing mode and the other switching means are switched for the opening switching means 8. Furthermore, the steam control valve opening switching means 8 receives the output from the nozzle governing function generators 3a to 3d, as well as the output from the throttle governing function generators 2a to 2d, so that the degree of opening is determined for all the steam control valves other than that under the control of the load control means. When the opening/change-over control switching means 5a to 5d are switched to the change-over control (the downsides of the switches in FIG. 1) the degree of opening of the steam control valves is determined by the steam control valve opening signal from the load control means 7 and the steam control valve opening switching means 8. As a result, the steam control valve opening switching means 8 starts to change the degree of opening of the steam control valves under the control thereof.

It is assumed here that switching from the throttle governing mode, the full lines Va to Vd is conducted when the steam control valve opening demand signal is x%, that is, the signal by which the turbine operates at a partial load of x% is inputted. It is assumed here that the load is controlled by the second valve Vb. That is. only the opening signal switching means 10b for the second valve Vb of four switching means 10a to 10d has been switched for the load control means 7, while the other switching means 10a, 10c and 10d have been switched for the steam control valve opening switching means 8. When switching begins in this state, all the first to fourth valves Va to Vd are held at a degree of opening A shown in FIG. 2, and the first steam control valve Va is operated from point A to Point D, while the third and fourth steam control valves Vc and Vd are operated from point A to point C as shown in FIG. 4. Meanwhile, the second valve Vd is adjusted so as to maintain a constant load. Finally, the degree of opening the second valve is also change to B, thus completing switching the speed governing mode. Thus, the throttle/nozzle governing mode is switched from the throttle mode to the nozzle shut-off mode and, thereafter, the opening/change-over control switching means changes from switching to ordinal side.

In the described embodiment, since the control of the load when switching the governing mode is conducted by a single valve, the error and offset due to time constants, as well as other control characteristics, are considerably reduced as compared with the case where load control is conducted by a plurality of steam control valves.

This invention minimizes the turbine load fluctuation when switching the speed governing mode.

What is claimed is:

1. A governing mode change-over apparatus of a steam turbine with a plurality of steam control valves for controlling steam supply to respective nozzles annularly arranged in the turbine, the apparatus comprising:

a control means for controlling the turbine to operate at a set load and generating a steam control valve opening demand signal;

first function generator means for said steam control valves for converting said steam control valve opening demand signal into a signal for opening said control valves in a throttle governing mode;

second function generator means for said steam control valve for converting said steam control valve opening demand signal into a signal for opening said control valves in a nozzle governing mode;

driving means for driving said steam control valves to control the opening thereof according to said signal from one of said first and second function generator means;

switching means for switching said first and second function generator means from one another and electrically connecting one of said first and second functioning generator means to said driving means;

load control means for comparing actual load with the set load and generating an electrical signal, for controlling the degree of opening of said control valve so as to nullify difference between the actual load and the set load;

steam control valve opening switching means, electrically connected to both said first and second function generator means, for generating valve opening signals for governing mode switching; and valve selecting means, electrically connected to said control means, for selecting at least one of said steam control valves in accordance with steam control valve opening signals from said control means so as to subject said selected valve to load control in accordance with signals from said load control means during the switching of the governing modes, and the other valves to opening degree switching operation for change over of the governing mode according to signals from said steam control valve opening switching means.

2. The governing mode change-over apparatus as defined in claim 1, wherein said steam control valve opening switching means generate signals for controlling the opening of each of said control valves such that the opening of each of said control valves in one of the throttle and nozzle governing modes is changed to an opening the same control valve necessary for another governing mode which is to be switched based on the output from said first and second function generators.

3. A governing mode change-over apparatus with a steam turbine with a plurality of steam control valves respectively provided for nozzles annularly arranged in the turbine to control steam supply thereto, the apparatus comprising:

a control means for controlling the turbine to operate at a set load and generating steam control valve opening demand signals;

first function generator means for converting said steam control valve opening demand signals into signals for controlling the opening of said respective steam control valves in a throttle governing mode;

second function generator means for converting said steam control valve opening demand signals into signals for controlling the opening of said respective steam control valves in a nozzle governing mode;

driving means for controlling the opening of said respective steam control valves independently of one another according to said signals from said first or second function generator means;

throttle/nozzle switching means for switching between said steam control valve opening signals for said throttle governing mode and for said nozzle governing mode;

opening signals switching means, electrically connected to said driving means for switching between said steam control valve opening signals for a state in which the governing modes are switched and a state in which the turbine is operated under turbine control according to said control means through said first or second function generator means;

load control means, electrically connected to said control means for comparing actual load with the set load and generating an electrical signal for controlling the opening of each of said control valves so as to nullify a difference between the actual load and the set load, said load control means being electrically connectable with said opening signal switching means; load control means being electrically connectable with said opening signal switching means;

steam control valve opening switching means, electrically connecting to both said first and second function generator means for generating valve opening signals for switching of a governing mode, said steam control valve opening switching means being electrically connectable with said opening signal switching means; and valve selecting means, electrically connected to said control means, for selecting at least one of said steam control valves so as to subject said selected valve to load control through opening signal switching means during the switching of the governing modes, and the other valves to opening degree switching operation to change over the governing mode.

4. A governing mode change-over apparatus according to claim 3, wherein said opening signal switching means is driven by said selecting means according to steam control valve opening command signals from said control means, for switching control valve opening signals between said load control means and said steam control valve opening switching so at least one of said steam control valves receives signals from said load control means and from said steam control valve opening switching means.

* * * * *